US011179952B2

(12) United States Patent
Hayashi

(10) Patent No.: US 11,179,952 B2
(45) Date of Patent: Nov. 23, 2021

(54) CONVEYING APPARATUS AND IMAGE FORMING APPARATUS

(71) Applicant: Tomoaki Hayashi, Tokyo (JP)

(72) Inventor: Tomoaki Hayashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/808,907

(22) Filed: Mar. 4, 2020

(65) Prior Publication Data

US 2020/0290376 A1 Sep. 17, 2020

(30) Foreign Application Priority Data

Mar. 14, 2019 (JP) ..... JP2019-047669

(51) Int. Cl.
*B41J 11/00* (2006.01)
*B41J 25/00* (2006.01)

(52) U.S. Cl.
CPC ..... *B41J 11/0095* (2013.01); *B41J 11/008* (2013.01); *B41J 25/001* (2013.01)

(58) Field of Classification Search
CPC ..... B41J 11/44; B41J 11/0095; B41J 11/008; B41J 25/001
See application file for complete search history.

(56) References Cited

U.S. PATENT DOCUMENTS 9,028,027 B2 5/2015 Bell et al.
2011/0316925 A1* 12/2011 Saita ..... B41J 3/60 347/19
2014/0295056 A1* 10/2014 Sato ..... B31D 1/027 427/8
2017/0165961 A1 6/2017 Hayashi et al.

FOREIGN PATENT DOCUMENTS

JP 2005-059451 3/2005
JP 2012-240786 12/2012
JP 2016-087891 5/2016
JP 2017-165094 9/2017
JP 2018-065681 4/2018
JP 2018-083406 5/2018
JP 2018-154077 10/2018

* cited by examiner

*Primary Examiner* — Justin Seo
(74) *Attorney, Agent, or Firm* — IPUSA, PLLC

(57) ABSTRACT

A conveying apparatus for conveying a conveyance object in a conveying direction is provided. The conveying apparatus includes a detecting unit configured to detect positions of a plurality of portions in an orthogonal direction of the conveyance object during the conveyance of the conveyance object, the orthogonal direction being orthogonal to the conveying direction; and a determining unit configured to make a determination as to whether the conveyance object has been subjected to expansion or contraction in the orthogonal direction, based on detection results of the positions of the plurality of portions.

8 Claims, 12 Drawing Sheets

CONVEYING APPARATUS AND IMAGE FORMING APPARATUS

CROSS-REFERENCE TO RELATED APPLICATIONS

The present application claims priority under 35 U.S.C. § 119 to Japanese Patent Application No. 2019-047669, filed on Mar. 14, 2019, the entire contents of which are incorporated herein by reference.

BACKGROUND OF THE INVENTION

1. Field of the Invention

The disclosures herein relate to a conveying apparatus and an image forming apparatus.

2. Description of the Related Art

Methods for utilizing head units to perform various processes are known. For example, image forming methods using an inkjet technique, ejecting ink from a print head onto a conveyance object, are known. Further, methods for utilizing such an image forming method to improve the quality of an image printed on a print medium are known.

For example, a method for forming a fine wiring pattern by correcting expansion and contraction of a web is known (see Patent Document 1, for example). In this method, reference marks are applied to the web, and the reference marks are detected by a charge-coupled device (CCD) camera. Then, based on the detected result, an arithmetic processing unit calculates status values of the web, such as the amount of expansion, the amount of slippage, or the amount of skew. Next, the original image data is corrected in accordance with the calculated status values. For example, when it is determined that there is the expansion of the web, the original image data is converted into an image in which the amount of expansion has been corrected. Further, when it is determined that there is the skew of the web, the original image data is converted into an image in which the amount of skew has been corrected.

However, there may be case in which a conveyance object may be moved in a direction (hereinafter simply referred to as an "orthogonal direction") orthogonal to a direction (hereinafter simply referred to as a "conveying direction") in which the conveyance object is conveyed. That is, what is termed as "meandering" of the conveyance object may occur. Further, there may also be case in which the conveyance object may expand or contract due to a change in tension. In the related-art method, it may be difficult to distinguish expansion or contraction of the web from movement in the orthogonal direction of the web.

RELATED-ART DOCUMENTS

Patent Documents

Patent Document 1: Japanese Unexamined Patent Application Publication No. 2012-240786

SUMMARY OF THE INVENTION

According to an embodiment of the present invention, a conveying apparatus for conveying a conveyance object in a conveying direction is provided. The conveying apparatus includes a detecting unit configured to detect positions of a plurality of portions in an orthogonal direction of the conveyance object during the conveyance of the conveyance object, the orthogonal direction being orthogonal to the conveying direction; and a determining unit configured to make a determination as to whether the conveyance object has been subjected to expansion or contraction in the orthogonal direction, based on detection results of the positions of the plurality of portions.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

It is a general object of the present invention to distinguish expansion or contraction of a conveyance object from movement in the orthogonal direction of the conveyance object during the conveyance of the conveyance object.

In the following, embodiments of the present invention will be described with reference to the accompanying drawings. In the specification and drawings, elements having substantially the same functions or configurations are referred to by the same numerals, and a duplicate description thereof will be omitted.

Overall Configuration

In the following, an example will be described, in which head units of a conveying apparatus correspond to liquid ejection head units that eject liquid.

Figure 1:
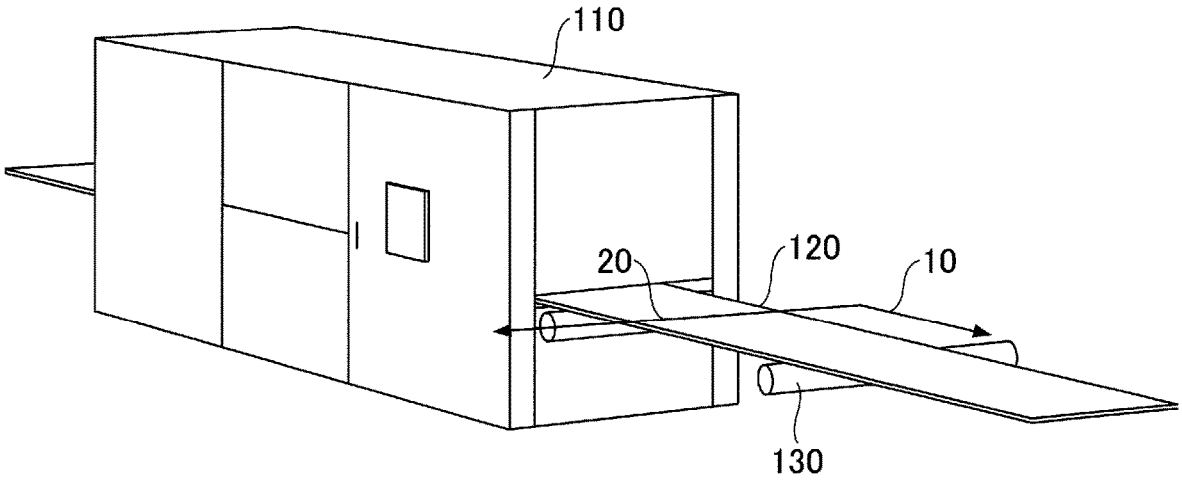
FIG. 1 is a schematic view of an example of a conveying apparatus according to an embodiment of the present invention.

FIG. 1 is a schematic view of an example of a liquid ejection apparatus according to an embodiment of the present invention. The liquid ejection apparatus is an example of a conveying apparatus. As illustrated in FIG. 1, the liquid ejection apparatus may be an image forming apparatus. Liquid ejected from the image forming apparatus is recording liquid, such as aqueous ink or oil-based ink. In the following, the liquid ejection apparatus will be described as an image forming apparatus 110.

A conveyance object may be a recording medium, for example. In the illustrated example, the image forming apparatus 110 ejects liquid onto a web 120, which is an example of a recording medium conveyed by a roller 30, so as to form an image on the web 120. Further, the web 120 is, for example, what is known as a continuous sheet printing medium. In other words, the web 120 may be a sheet that can be wound in a roll shape.

The image forming apparatus 110 is what is known as a production printer. In the following description, the roller 30 adjusts the tension of the web 120, and conveys the web 120 in a direction (hereinafter referred to as a "conveying direction 10") illustrated in FIG. 1. Further, in the example illustrated in FIG. 1, a direction orthogonal to the conveying direction 10 is referred to as an "orthogonal direction 20". In addition, in the example illustrated in FIG. 1, the image forming apparatus 110 serves as an inkjet printer that forms an image at a predetermined position of the web 120 by ejecting inks of four colors of black (K), cyan (C), magenta (M), and yellow (Y).

Figure 2:
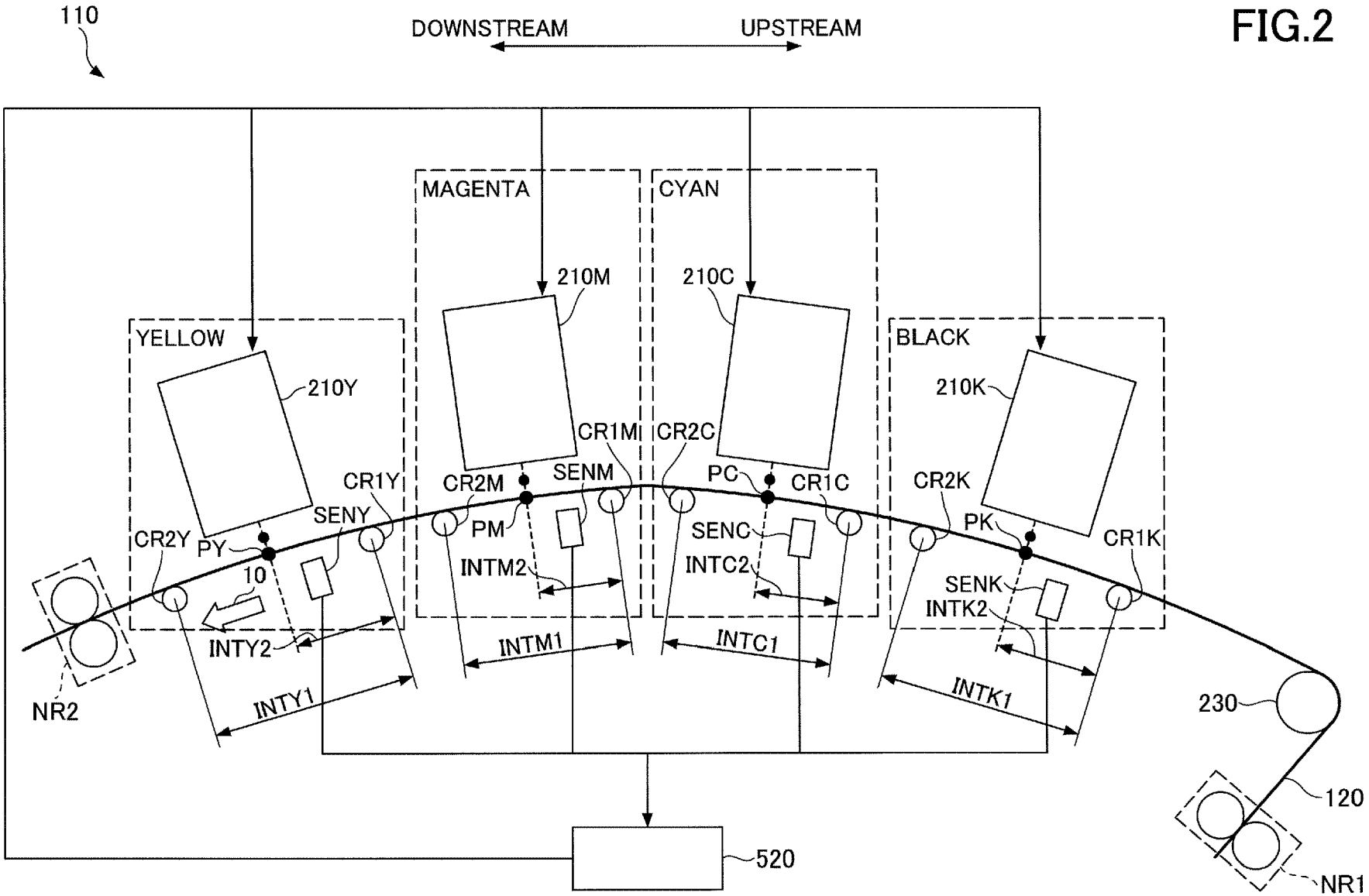
FIG. 2 is a schematic view of the overall configuration of the conveying apparatus according to an embodiment of the present invention.

FIG. 2 is a schematic view of the overall configuration of the liquid ejection apparatus according to an embodiment of the present invention. As illustrated in FIG. 2, the image forming apparatus 110 includes four liquid ejection head units that eject inks of the respective four colors.

The liquid ejection head units eject ink onto the web 120 that is conveyed in the conveying direction 10. Further, it is assumed that the web 120 is conveyed by two pairs of nip rollers and a roller 230. One pair of nip rollers, of the two pairs of nip rollers, disposed upstream of the liquid ejection head units is hereinafter correctively referred to as a "first nip roller NR1". The other pair of nip rollers disposed downstream of the liquid ejection head units is hereinafter correctively referred to as a "second nip roller NR2". As illustrated in FIG. 2, the nip rollers rotate while sandwiching a conveyance object such as the web 120. As described, the nip rollers and the roller 230 serve as a mechanism for conveying the conveyance object (a recording medium) such as the web 120 in a predetermined direction.

Further, it is desirable for the recording medium such as the web 120 to have an elongated form. Specifically, the length of the recording medium is desired to be longer than the distance between the first nip roller NR1 and the second nip roller NR2. Note that the recording medium is not limited to the web, and may be "Z-fold paper", which is a sheet stored in a folded state.

In the example of the overall configuration illustrated in FIG. 2, it is assumed that the liquid ejection head units are disposed in the order of black (K), cyan (C), magenta (M) and yellow (Y) from the upstream side to the downstream side. That is, a liquid ejection head unit for black (K) (hereinafter referred to as a "black liquid ejection head unit 210K") is disposed at the most upstream side. A liquid ejection head unit for cyan (C) (hereinafter referred to as a "cyan liquid ejection head unit 210K") is disposed next to the black liquid ejection head unit 210K. Further, a liquid ejection head unit for magenta (M) (hereinafter referred to as a "magenta liquid ejection head 210M") is disposed next to the cyan liquid ejection head unit 210C. Further, a liquid ejection head unit for yellow (Y) (hereinafter referred to as a "yellow liquid ejection head unit 210Y") is disposed at the most downstream side.

The liquid ejection head units eject inks of the respective colors onto predetermined positions of the web 120 based on image data. The positions of the web 120 onto which the ejected inks land (hereinafter referred to as "landing positions") are approximately directly below the liquid ejection head units. In the following, processing positions at which the liquid ejection head units perform processes are described as the landing positions.

In the example of FIG. 2, black ink is ejected onto a landing position of the black liquid ejection head unit 210K (hereinafter referred to as a "black landing position PK"). Similarly, cyan ink is ejected onto a landing position of the cyan liquid ejection head unit 210C (hereinafter referred to as a "cyan landing position PC"). Further, magenta ink is ejected onto a landing position of the magenta liquid ejection head 210M (hereinafter referred to as a "magenta landing position PM"). In addition, yellow ink is ejected onto a landing position of the yellow liquid ejection head unit 210Y (hereinafter referred to as a "yellow landing position PY").

Specifically, a timing at which each of the liquid ejection head units ejects ink is preferably controlled by a controller 520 that is connected to each of the liquid ejection head units, for example.

Further, multiple rollers are preferably provided for each of the liquid ejection head units. For example, as illustrated in FIG. 2, rollers may be provided upstream and downstream of each of the liquid ejection head units. In the example illustrated in FIG. 2, a roller (hereinafter referred to as a "first roller") used to convey the web 120 to the landing position of a corresponding liquid ejection head unit is provided upstream of the corresponding liquid ejection head unit. In addition, a roller (hereinafter referred to as a "second roller") used to convey the web 120 from the landing position to the downstream side of the corresponding liquid ejection head unit is provided downstream of the corresponding liquid ejection head units.

As described, by providing the first roller and the second roller, it is possible to minimize "fluttering" of the web at the landing positions of the liquid ejection head unit. Note that the first roller and the second roller are used to convey the recording medium, and may be driven rollers, for example. The first roller and the second roller may also be rollers driven to rotate by a motor, for example.

Note that the first roller, which is an example of a first support member, and the second roller, which is an example of a second support member, are not required to be rotating bodies such as driven rollers. That is, the first roller and the second roller may be any suitable members capable of supporting the conveyance object. For example, each of the first support member and the second support member may be a pipe or a shaft having a circular cross-sectional shape. In another example, each of the first support member and the second support member may be a curved plate having an arc-shaped portion that comes into contact with the conveyance object. In the following, the first roller is described as an example of the first support member, and the second roller is described as an example of the second support member.

Specifically, in order for the black liquid ejection head unit 210K to accurately eject black ink onto a predetermined position of the web 120, a first roller CR1K used to convey the web 120 to the black landing position PK is provided upstream of the black liquid ejection head unit 210K. Further, a second roller CR2K used to convey the web 120 from the black landing position PK to the downstream side is provided downstream of the black liquid ejection head unit 210K.

Similarly, a first roller CR1C and a second roller CR2C are respectively provided upstream and downstream of the cyan liquid ejection head unit 210C. Further, a first roller CR1M and a second roller CR2M are respectively provided upstream and downstream of the magenta liquid ejection head unit 210M. Further, a first roller CR1Y and a second roller CR2Y are respectively provided upstream and downstream of the yellow liquid ejection head unit 210Y.

For example, the image forming apparatus 110 includes sensors that detect the position, the speed, the acceleration, combinations thereof, of the recording medium in the orthogonal direction, in the conveying direction, or in both the directions (hereinafter simply referred to as "sensors").

Further, the installation positions of the sensors are preferably located close to the respective landing positions, as indicated by positions of a black sensor SENK, a cyan sensor SENC, a magenta sensor SENM, and a yellow sensor SENY illustrated in FIG. 2. By installing the sensors close to the respective landing positions, the distances between the sensors and the respective landing positions decrease. By decreasing the distances between the sensors and the respective landing positions, detection error can be reduced. Accordingly, the image forming apparatus 110 is able to accurately detect the position of the conveyance object with the sensors.

Specifically, the installation positions of the sensors close to the respective landing positions are located between the first rollers and the second rollers. In the example illustrated in FIG. 2, the installation position of the black sensor SENK is preferably located within a range of INTK1 between the first roller CR1K and the second roller CRK2. Similarly, the installation position of the cyan sensor SENC is preferably located within a range of INTC1 between the first roller CR1C and the second roller CR2C. Further, the installation position of the magenta sensor SENM is preferably located within a range of INTM1 between the first roller CR1M and the second roller CR2M. Moreover, the installation position of the yellow sensor SENY is preferably located within a range of INTY1 between the first roller CR1Y and the second roller CY2Y.

As described above, by installing each of the sensors between corresponding rollers, each of the sensors is able to detect the position of the conveyance object at a position close to a corresponding landing position. Note that the moving speed of the conveyance object tends to be relatively stable between the rollers. Therefore, the image forming apparatus 110 is able to detect the position of the conveyance object with high accuracy.

Further, each of the sensors is preferably installed at a position closer to a corresponding first roller than to a landing position. In other words, a sensor is preferably installed on the upstream side relative to a corresponding landing position.

Specifically, the black sensor SENK is preferably installed on the upstream side relative to the black landing position PK, in an area (hereinafter referred to as a "black upstream area INTK2") between the landing position PK and the first roller CR1K. Similarly, the cyan sensor SENC is preferably installed on the upstream side relative to the cyan landing position PC, in an area (hereinafter referred to as a "cyan upstream area INTC2") between the cyan landing position PC and the first roller CR1C. Further, the magenta sensor SENM is preferably installed on the upstream side relative to the magenta landing position PM, in an area (hereinafter referred to as a "magenta upstream area INTM2") between the magenta landing position PM and the first roller CR1M. Moreover, the yellow sensor SENY is preferably installed on the upstream side relative to the yellow landing position PY, in an area (hereinafter referred to as a "yellow upstream area INTY2") between the yellow landing position PY and the first roller CR1Y.

By installing the sensors in the black upstream area INTK2, the cyan upstream area INTC2, the magenta upstream area INTM2, and the yellow upstream area INTY2, the image forming apparatus 110 is able to detect the position of the conveyance object with high accuracy.

Note that it may be desirable for the sensors to be installed directly below the liquid ejection head units in some cases. By installing the sensors directly below the liquid ejection head units, the amount of movement can be accurately detected. However, it may take time for information processing and control operations to be performed upon receiving detection signals from the sensors. For this reason, ejecting inks onto accurate positions would be difficult, and as a result, a color shift would occur.

Conversely, when the sensors are installed upstream of the liquid ejection head units, there is a sufficient period of time to calculate one or both of a liquid ejection timing and the amount of movement before the conveyance object reaches a position directly below a corresponding liquid ejection head unit. Accordingly, it is possible to suppress a color shift, thus improving image quality.

In addition, the installation of the sensors near the landing positions may be structurally restricted in some cases. Therefore, it is preferable for the sensors to be installed upstream of the liquid ejection head units.

However, if the landing positions can be changed without requiring time for control operations and there are also no structural restrictions, the sensors may be installed directly below the liquid ejection head units, of course.

Further, if errors can be tolerated, the sensors may be installed directly below the liquid ejection head units, or may be installed downstream of the liquid ejection head units at positions between the first rollers and the second rollers.

Example of Meandering

"Meandering", that is, the movement in the orthogonal direction of the conveyance object with respect to reference positions is a phenomenon as described below.

Figure 3A:
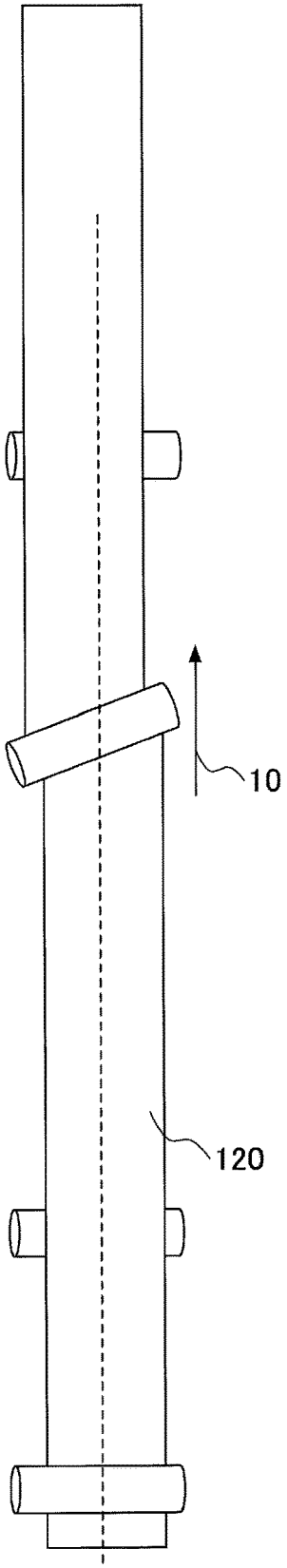
FIGS. 3A and 3B are diagrams illustrating example positional variations of a conveyance object.
Figure 3B:
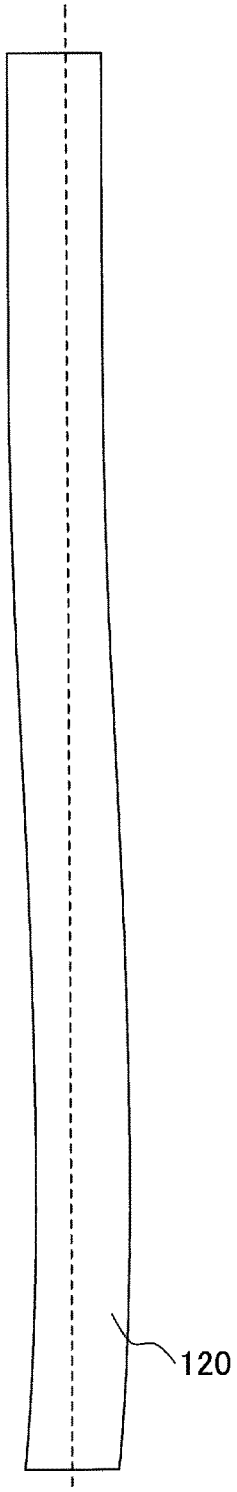

FIGS. 3A and 3B are diagrams illustrating example positional variations in the orthogonal direction of the conveyance object. In the example of FIG. 3A, the web 120 is conveyed in the conveying direction 10. In the example of FIG. 3A, a roller is slanted with respect to the conveyance direction 10. In FIG. 3A, the roller is conspicuously slanted to facilitate understanding, and the roller may be less slanted than the illustrated example. In this case, when the web 120 is conveyed, the position in the orthogonal direction 20 of the web 120 may fluctuate as illustrated in FIG. 3B. That is, the web 120 may meander as illustrated in FIG. 3B.

Positional variations in the orthogonal direction of the web 120, namely "meandering" of the web 120 may be caused by eccentricity or misalignment of conveying rollers or cutting of the web 120 with a blade, for example. Further, in a case where the web 120 has a narrow width in the orthogonal direction, thermal expansion of the rollers may affect positional variations in the orthogonal direction of the web 120.

For example, when vibration is caused by eccentricity of the rollers or by cutting of the web 120 with a blade, the web 120 may "meander" as illustrated in FIG. 35. In addition, if the cutting of the web 120 with the blade is uneven, physical properties of the web 120, namely the shape of the web 120 after being cut may cause the web 120 to "meander".

Figure 4:
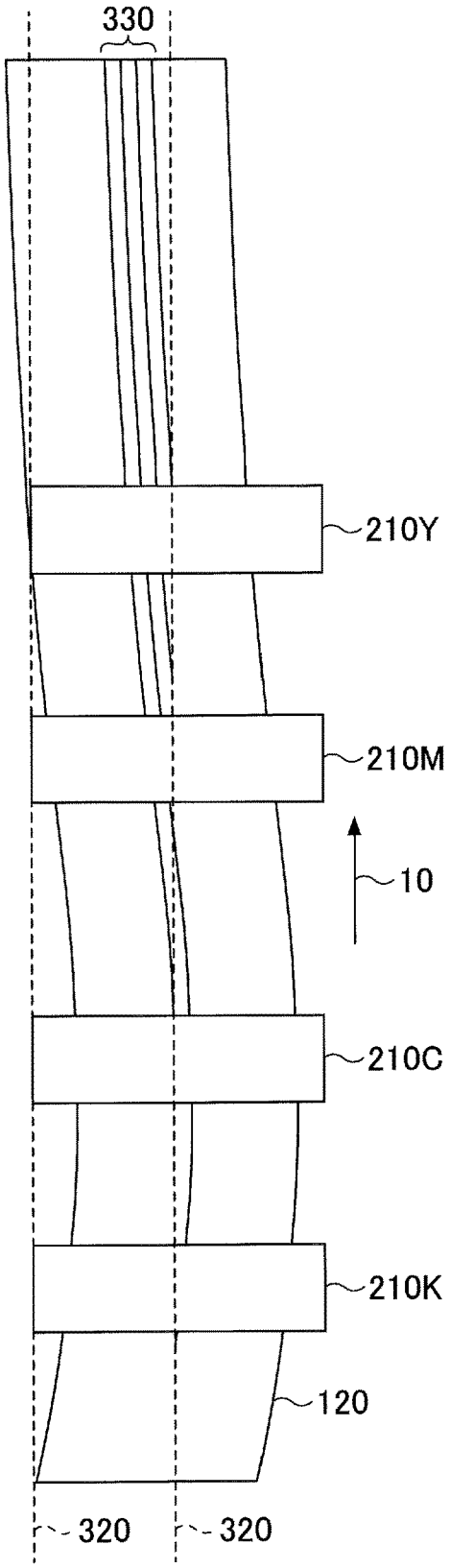
FIG. 4 is a diagram illustrating an example cause of a color shift.

FIG. 4 is a diagram illustrating an example cause of a color shift. As described above with reference to FIGS. 3A and 35, when the conveyance object is moved in the orthogonal direction with respect to reference positions, namely when the conveyance object "meanders", a color shift may readily occur in the manner described below.

Specifically, as illustrated in FIG. 4, in order to form an image with a plurality of colors, namely in order to form a color image, the image forming apparatus 110 forms the color image on the web 120 by using color planes, that is, by superimposing inks of the plurality of different colors ejected from the liquid ejection head units.

When the web 120 "meanders", the position of the web 120 is moved with respect to reference positions. For example, the web 120 may meander with respect to reference lines 320. In this case, when the liquid ejection head units eject inks onto the web 120, a color shift 330 may occur due to positional variations in the orthogonal direction of the web 120. That is, the color shift 330 occurs as a result of lines formed by the inks ejected from the liquid ejection head units being shifted in the orthogonal direction. As described above, if the color shift 330 occurs, the quality of an image formed on the web 120 may be degraded.

Example of Entire Process

Figure 5:
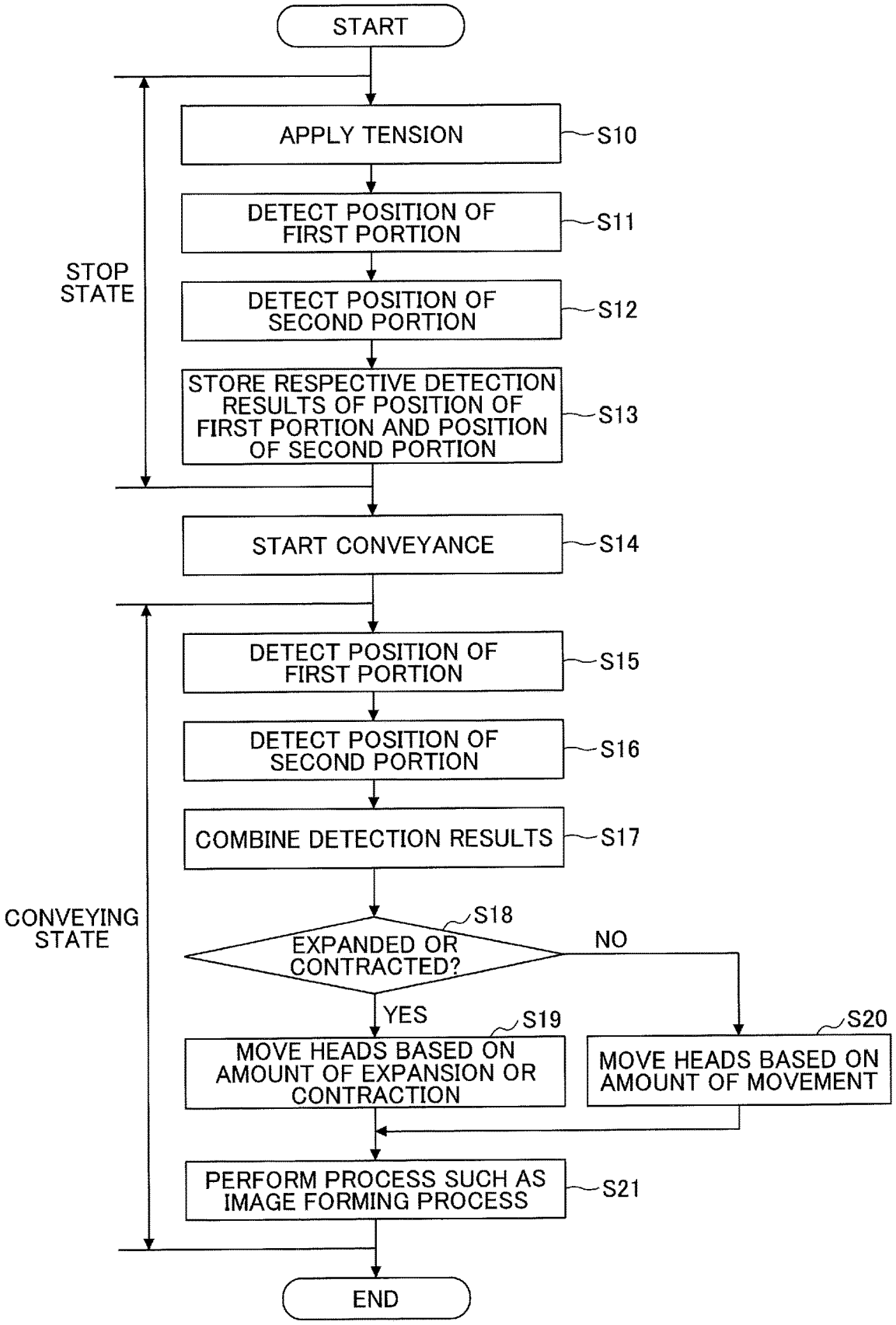
FIG. 5 is a flowchart illustrating an example of the entire process according to an embodiment of the present invention.

FIG. 5 is a flowchart illustrating an example of the entire process according to an embodiment of the present invention. As illustrated in FIG. 5, a process in steps S10 through S13 is preferably performed while a conveyance object is stopped (hereinafter simply referred to as a "stop state"). In the following, an example will be described, in which the process performed in the stop state and a process performed in a state in which the conveyance object is being conveyed (hereinafter simply referred to as a "conveying state") are performed in a row.

Note that the process performed in the stop state and the process performed in the conveying state are not required to be performed in a row. That is, the process in the stop state may be performed only at the time of initialization.

In step S10, the conveying apparatus applies tension to the conveyance object. The tension applied to the conveyance object in the stop state is hereinafter referred to as "first tension". The first tension pulls the conveyance object in the stop state, thereby making the conveying apparatus ready to perform a process such as an image forming process on the conveyance object.

In step S11, the conveying apparatus detects the position of a first portion of the conveyance object.

In step S12, the conveying apparatus detects the position of a second portion of the conveyance object.

In step S13, the conveying apparatus stores a detection result of the position of the first portion and a detection result of the position of the second portion of the conveyance object.

For example, step S10 through step S13 are performed as follows.

Figure 6:
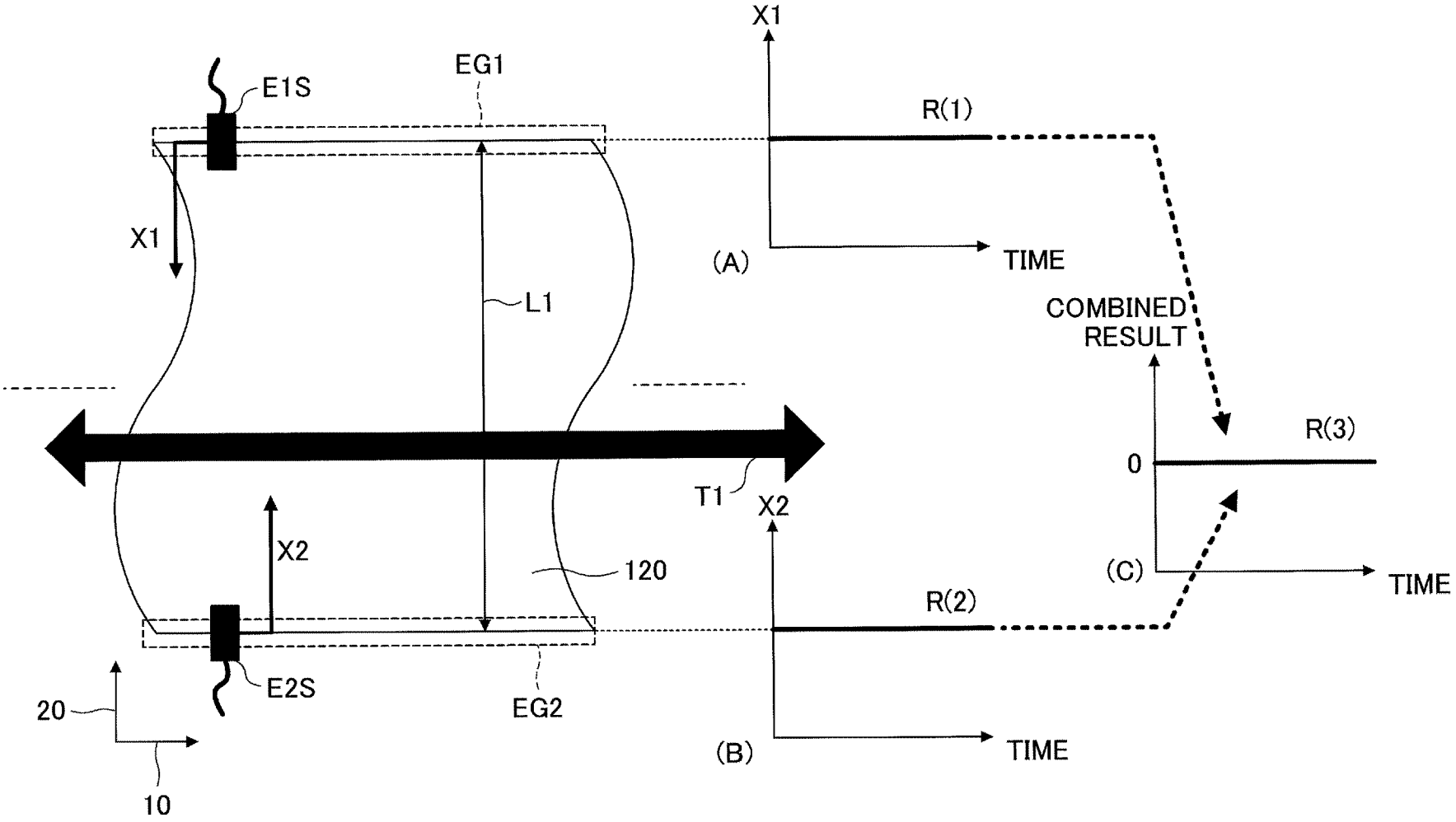
FIG. 6 is a diagram illustrating an example of a process performed in a stop state according to an embodiment of the present invention.

FIG. 6 is a diagram illustrating an example of the process performed in the stop state according to an embodiment of the present invention.

As illustrated in FIG. 6, first tension T1 is applied to the conveyance object in the conveying direction 10. In the following, a "first dimension L1" indicates the dimension of the conveyance object that is in the stop state and is being subjected to the first tension T1.

As illustrated in FIG. 6, the first dimension L1 is determined by results of detected positions of a plurality of portions. In the example of FIG. 6, the plurality of portions include an upper end portion of the web 120 (hereinafter referred to as a "first portion EG1"), and a lower end portion of the web 120 (hereinafter referred to as a "second portion EG2". Namely, the plurality of portions include edge portions of the web 120.

A sensor that detects the position of the first portion EG1 of the web 120 is referred to as a first sensor E1S. Similarly, a sensor that detects the second portion EG2 of the web 120 is referred to as a second sensor E2S.

Further, the positions of the edge portions in the orthogonal direction 20 of the web 120 detected by the first sensor E1S and the second sensor E2S in the stop state are stored as reference positions, and the reference positions are used in the subsequent process performed in the conveying state. Specifically, the positions detected in step S13 in the stop state are set to "0", and distances by which the web 120 is moved from the positions detected in step S13 are detected as positive values or negative values in the subsequent process.

Further, FIG. 6 illustrates the stop state of the web 120 that is being subjected to the constant first tension T1.

A graph (A) illustrated in FIG. 6 indicates the detection result obtained from the first sensor E1S. In the graph, the detection result is maintained constant as there are no positional variations with respect to the reference position (In FIG. 6, the first sensor E1S detects variations in the position of the first portion EG1 in the "x1" direction. Specifically, if the first portion EG1 is moved downward in FIG. 6, the first sensor E1S outputs a positive value).

A function indicating the detection result detected by the first sensor E1S, namely indicating the detection result in step 11 is hereinafter referred to as a function "R(1)".

A graph (B) illustrated in FIG. 6 indicates the detection result obtained from the second sensor E2S. In the graph, the detection result is maintained constant as there are no positional variations with respect to the reference position (In FIG. 6, the second sensor E2S detects variations in the position of the second portion EG2 in the "X2" direction. Specifically, if the second portion EG2 is moved upward in FIG. 6, the second sensor E2S outputs a positive value).

A function indicating the detection result detected by the second sensor E2S, namely indicating the detection result in step 12 is hereinafter referred to as a function "R(2)".

Then, the conveying apparatus combines "R(1)" and "R(2)". A graph (C) in FIG. 6 indicates a result that combines the detection result of the first portion EG1 and the detection result of the second portion EG2 of the web 120 in the stop state. Specifically, "R(1)" and "R(2)" are equal to "0" and are constant (that is, the combined result indicates that the detected positions are at the reference positions). Therefore, the combined result "(R)3" is equal to "0", and is a constant function.

In the example of FIG. 6, sensing directions in the orthogonal direction 20 of the first sensor E1S and the second sensor E2S are opposite to each other. Accordingly, the first sensor E1S outputs a "positive" value if the first sensor E1S detects movement of the first portion EG1 toward the center of the web 120 (downward in FIG. 6). Conversely, the second sensor E2S outputs a "positive" value if the second sensor E2S detects movement of the second portion EG2 toward the center of the web 120 (upward in FIG. 6).

It is desirable to obtain the detection results as described above in the stop state of the web 120.

Next, after the detection results as described above are obtained, the conveying apparatus causes the process to proceed to step S14.

In step S14, the conveying apparatus starts the conveyance of the web 120. The conveying apparatus performs the process as of step 15 while the web 120 is in the conveying state, namely during the conveyance of the web 120.

In step S15, the conveying apparatus detects the position of the first portion. For example, step S15 is similar to step S11.

In step S16, the conveying apparatus detects the position of the second portion. For example, step S16 is similar to step S12.

In step S17, the conveying apparatus combines detection results.

In step S18, the conveying apparatus determines whether the web 120 has expanded or contracted (i.e., whether the web 120 is subjected to expansion or contraction). When it is determined that the web 120 has expanded or contracted (yes in step S18), the conveying apparatus causes the process to proceed to step S19. Conversely, when it is determined that the web 120 has not expanded or contracted (no in step S18), the conveying apparatus causes the process to proceed to step S20.

In step S19, the conveying apparatus moves the heads based on the amount of expansion or contraction.

In step S20, the conveying apparatus moves the heads based on the amount of movement.

In step S21, the conveying apparatus performs a process such as an image forming process.

The following describes an example in which the web 120 has moved in the orthogonal direction, namely it is determined the web 120 has not expanded or contracted.

Figure 7:
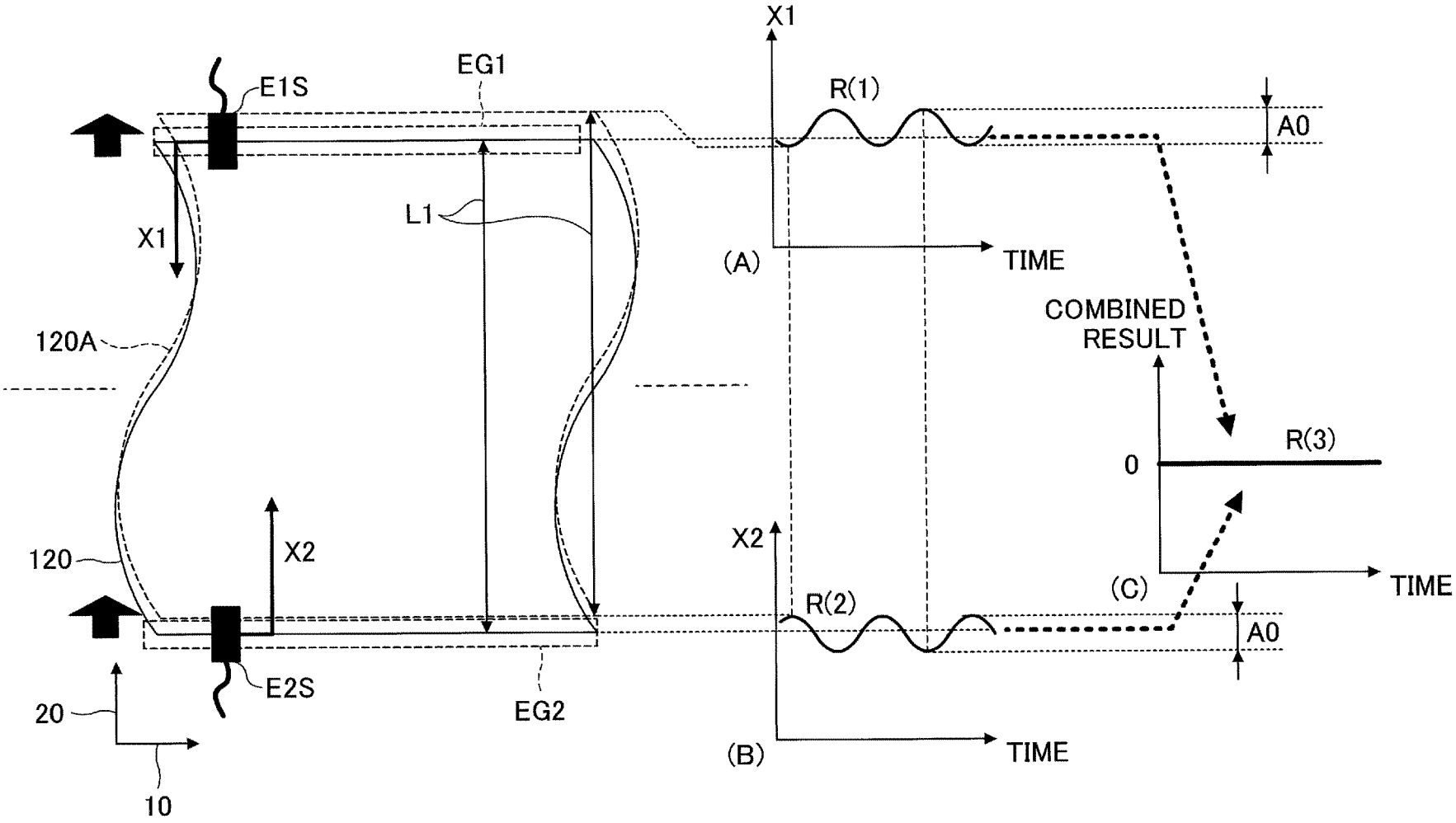
FIG. 7 is a diagram illustrating an example of a process performed in a meandering state according to an embodiment of the present invention.

FIG. 7 is a diagram illustrating an example of a process performed in a "meandering" state according to an embodiment of the present invention. As described above, the stop state of the conveyance object is as indicated by the web 120 of FIG. 6. In FIG. 7, it is assumed that the conveyance object has "meandered" as indicated by a web 120A. In the example of FIG. 7, the web 120A has "meandered", but has not expanded or contracted. Therefore, it is assumed that the first dimension L1 of the web 120A remains the same.

First, the position of the first portion EG1 is detected as indicated by a graph (A) of FIG. 7. Specifically, the first portion EG1 of the web 120A moves as if the first portion EG1 periodically vibrates with an amplitude of "A0" as indicated by the graph (A) of FIG. 7.

Next, the position of the second portion EG2 is detected as indicated by a graph (B) of FIG. 7. Specifically, the second portion EG2 of the web 120A moves as if the second portion EG2 periodically vibrates with an amplitude of "A0" as indicated by the graph (B) of FIG. 7.

As in the case of the stop state, the sensing directions in the orthogonal direction 20 of the first sensor E1S and the second sensor E2S are opposite to each other. Even when the web 120A meanders in the orthogonal direction 20, the first dimension L1 of the web 120A remains the same. Therefore, as indicated by the graphs (A) and (B) of FIG. 7, "R(1)" and "R(2)" have the same amplitude "A0" and opposite phases. Because the waves of opposite phases are combined, the waves cancel each other, and R(3) is thus approximately equal to 0 as indicated by a graph (C) of FIG. 7.

Accordingly, if a combined result as indicated by the graph (C) of FIG. 7 is obtained in step S17, the conveying apparatus determines that there is no expansion or contraction (no in step S18). In such a case, the conveying apparatus moves the heads based on the amount of movement, that is, based on the amount of "meandering" in step S20. Accordingly, even if the conveyance object meanders, the conveying apparatus is able to perform an image forming process with high accuracy, thus providing high-quality images.

Conversely, the following describes an example when it is determined that the conveyance object has expanded or contracted.

Figure 8:
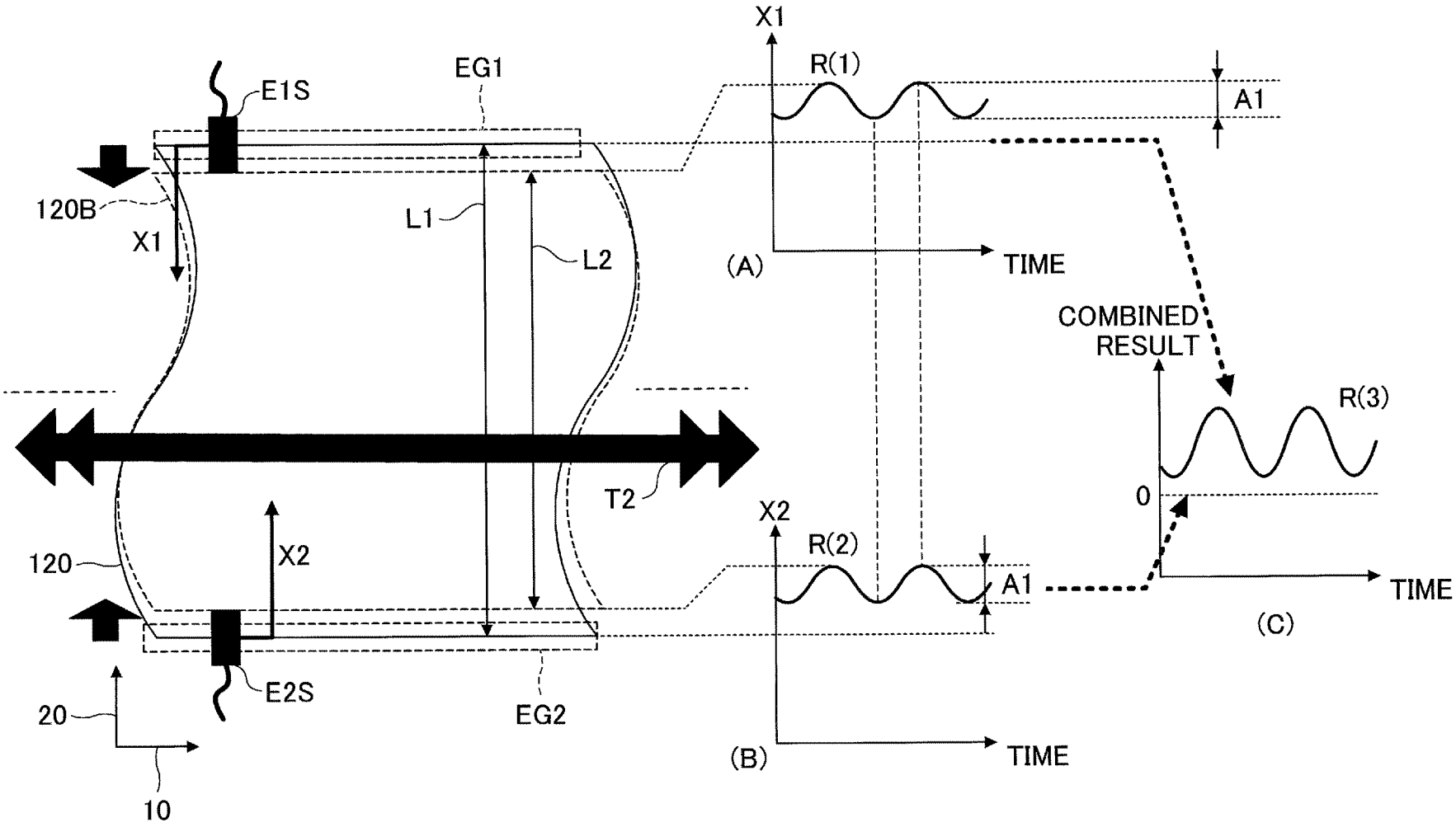
FIG. 8 is a diagram illustrating an example of a process performed in the case of expansion or contraction according to an embodiment of the present invention.

FIG. 8 is a diagram illustrating an example of a process performed in the case of expansion or contraction according to an embodiment of the present invention.

In FIG. 8, it is assumed that the conveyance object has contracted as indicated by a web 120B.

Firstly, in the state illustrated in FIG. 8, the conveyance object is subjected to tension different from that applied in the stop state. Specifically, while the conveyance object in the stop state is subjected to the first tension T1, the conveyance object in the state illustrated in FIG. 8 is subjected to second tension T2. The second tension T2 varies periodically.

Therefore, as the second tension T2 increases, the dimension of the conveyance object decreases. For example, in the example of FIG. 8, the web 120B has a smaller dimension than that of the web 120. The smaller dimension is hereinafter referred to as a "second dimension L2". As illustrated in FIG. 8, the second dimension L2 is smaller than the first dimension L1. That is, the relationship between the second dimension L2 and the first dimension L1 can be expressed by the following formula (1).

$$\text{Second dimension } L2 = \text{first dimension } L - \alpha \quad (1)$$

In the above formula (1), $\alpha$ represents the amount of contraction in the orthogonal direction 20 of the conveyance object. That is, as indicated by the above formula (1), $\alpha$ is a value indicating the difference between the second dimension L2 and the first dimension L1. Note that the amount of expansion or contraction differs depending on the material of the conveyance object or the amount of thermal expansion of the rollers for conveying the conveyance object.

In the example of FIG. 8, it is assumed that the conveyance object has contracted symmetrically in the vertical (orthogonal) direction. In other words, in the example of FIG. 8, it is assumed that the first portion EG1 and the second portion EG2 of the conveyance object have contracted equally. In this case, because the total amount of contraction is "$\alpha$", the amount of contraction of the first portion EG1 is "½ $\alpha$", and the amount of contraction of the second portion EG2 is also "½ $\alpha$".

A graph (A) of FIG. 8 indicates a detection result of the first portion EG1 in the above-described state. Specifically, the detection result of the first portion EG1 varies due to changes in the amount of contraction over time. Similarly, a graph (B) of FIG. 8 indicates a detection result of the second portion EG2.

Because the amount of contraction of the first portion EG1 is the same as the amount of contraction of the second portion EG2, "R(1)" and "R(2)" have the same amplitude "A1" as illustrated by the graph (A) of FIG. 8. In addition, "R(1)" and "R(2)" have the same phase. In other words, when the conveyance object has contracted symmetrically in the vertical (orthogonal) direction, the same waveforms are detected as indicated by "R(1)" and "R(2)".

Next, a graph (C) indicates a result that combines the detection result of the first portion EG1 and the detection result of the second portion EG2. Namely, the graph (C) indicates a result that combines "R(1)" and "R(2)". Contrary to the graph (C) of FIG. 7, which is the example of "meandering", the waveforms of the same phase are combined. As a result, the graph (C) of FIG. 8 indicates a combined waveform having an amplitude larger than "R(1)" and "R(2)".

Accordingly, by referring to the combined waveform generated in step S17, the conveying apparatus can determine whether the conveyance object has expanded or contracted (step S18).

Note that a method for determining whether the conveyance object has expanded or contracted is not limited to the above-described determination method based on a combined result. That is, any method may be employed to determine expansion or contraction as long as the method can determine whether "R(1)" and "R(2)" have the same phase or opposite phases. In other words, any method capable of determining the phase relationship between "R(1)" and "R(2)" may be employed to determine expansion or contraction.

In addition, the sensors may be of any type as long as the position of the conveyance object can be detected. For example, the sensors utilize a laser, air pressure, photoelectricity, ultrasound, infrared, light, or combinations thereof to detect the position of the conveyance object.

Further, the sensors are not required to have an opposite directional relationship. For example, in the above-described embodiment, the sensing directions of the first sensor E1S and the second sensor E2S may be the same. In this case, the determination of "meandering" and the determination of "expansion or contraction" based on the same phase or different phases are reversed. Specifically, the sensing directions of both the first sensor E1S and the second sensor E2S may be in the positive X2 direction. In this case, if detection results indicate the same phase, the conveying apparatus determines that there is meandering. Conversely, if detection results indicate opposite phases, the conveying apparatus determines that there is expansion or contraction. In this manner, the determination may be changed in accordance with the directions of the sensors.

Further, the order of detection steps is not limited to the above-described order. That is, the detection steps may be in any order other than the order of the first portion and the second portion. For example, the position of the first portion and the position of the second portion may be detected in reverse order, or may be detected simultaneously. Further, the plurality of portions may be three or more portions.

Further, the overall process illustrated in FIG. 5 may be performed on a per-head basis, that is, on a per-color basis. In this case, the movement in step S19 or S20 may be performed on a per-head basis.

As described above, when it is determined that there is expansion or contraction, it is desirable for the conveying apparatus to move the head(s) to correct the amount of expansion or contraction by performing step S19.

Configuration Example of Moving Mechanism

Figure 9:
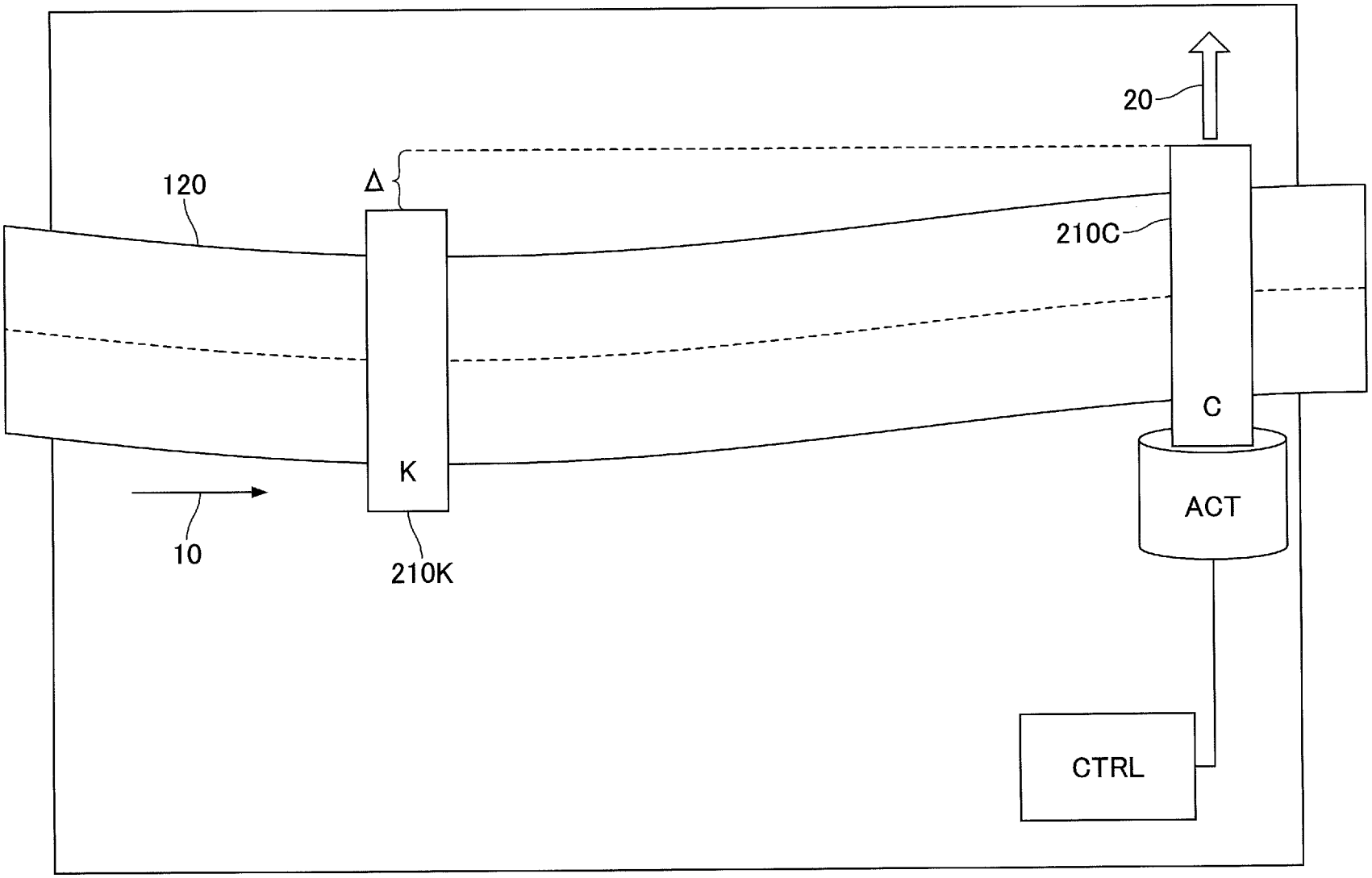
FIG. 9 is a block diagram illustrating an example of a moving mechanism for moving a head of the conveying apparatus according to an embodiment of the present invention.

FIG. 9 is a block diagram illustrating an example of a moving mechanism for moving a head of the conveying apparatus according to an embodiment of the present invention. For example, the moving mechanism may be implemented by hardware illustrated in FIG. 9. FIG. 9 illustrates the moving mechanism for moving the cyan liquid ejection head unit 210C, which is an example of a head.

In the illustrated example of FIG. 9, an actuator ACT such as a linear actuator for moving the cyan liquid ejection head unit 210C is provided for the cyan liquid ejection head unit 210C. Further, a controller CTL that controls the actuator ACT is connected to the actuator ACT.

The actuator ACT may be a linear actuator or a motor, for example. In addition, the actuator ACT may include a control circuit, a power supply circuit, and mechanical components, for example.

The controller CTL receives a detection result. The controller CTL controls the actuator ACT to move the cyan liquid ejection head unit 210C to compensate for a positional variation of the web 120 indicated by the detection result.

In the example illustrated in FIG. 9, the detection result indicates, for example, a variation Δ. Thus, in the example illustrated in FIG. 9, the controller CTL moves the cyan liquid ejection head unit 210C in the orthogonal direction 20 to compensate for the variation Δ.

With the moving mechanism implemented as described above, the conveying apparatus can highly accurately perform a process even if the position in the orthogonal direction 20 of a conveyance object varies, namely even if the conveyance object "meanders".

A method for moving the heads differs depending on whether the conveyance object has "meandered" or the conveyance object has "expanded or contracted". The following describes an example in which the lower left of FIG. 8 is regarded as the origin. That is, the movement of the heads is expressed in the same coordinate system as "X2".

In the case of the "meandering" of the conveyance object, the amount of "meandering" can be corrected by moving the heads in accordance with a detection result (such as "R(2)") regardless of positions where the heads perform a process.

Conversely, in the case of expansion or contraction, the upper half and the lower half of the conveyance object expand or contract in opposite directions. In other words, although the amount of expansion or contraction is the same, the direction in which the upper end portion of the conveyance object expands or contracts differs from the direction in which the lower end portion of the conveyance object expands or contracts. Therefore, when the heads perform a process on the lower half of the conveyance object, the heads are moved to correct the amount of expansion or contraction in the "X2" direction. Further, when the heads perform a process on the upper half of the conveyance object, the heads are moved to correct the amount of expansion or contraction in the "X1" direction. As described, in the case of the expansion or contraction of the conveyance object, it is preferable to switch moving directions of the heads at a symmetric position of the conveyance object (in the example of FIG. 8, at the center position in the orthogonal direction 20 of the conveyance object, namely at the middle position of the upper and lower end portions of the conveyance object). With the above configuration, the heads are moved in accordance with the direction of the sensor located closer to a position where the heads perform a process. It is preferable for the conveying apparatus to correct the position where the heads perform a process by moving the heads in accordance with the amount of expansion or contraction and also the direction of expansion or contraction.

Note that the symmetric position is not limited to the middle position of the upper and lower end portions. For example, by detecting additional positions in addition to the above-described positions (such as the positions of the first portion EG1 and the second portion EG2) of the conveyance object, it is possible to identify in which direction (in the example illustrated in FIG. 8, either the "X1" direction or the "X2" direction) expansion or contraction occurs at the additional positions. Accordingly, by detecting multiple positions of the conveyance object, it is possible to identify a position where the direction of expansion or contraction changes or identify a position where expansion or contraction is extremely small. The conveying apparatus may use a position identified as described above as the symmetric position.

Note that the conveying apparatus may shift the conveyance object so as to cancel the effect of expansion or contraction, in accordance with the "meandering" of the conveyance object.

Example of Functional Configuration

Figure 10:
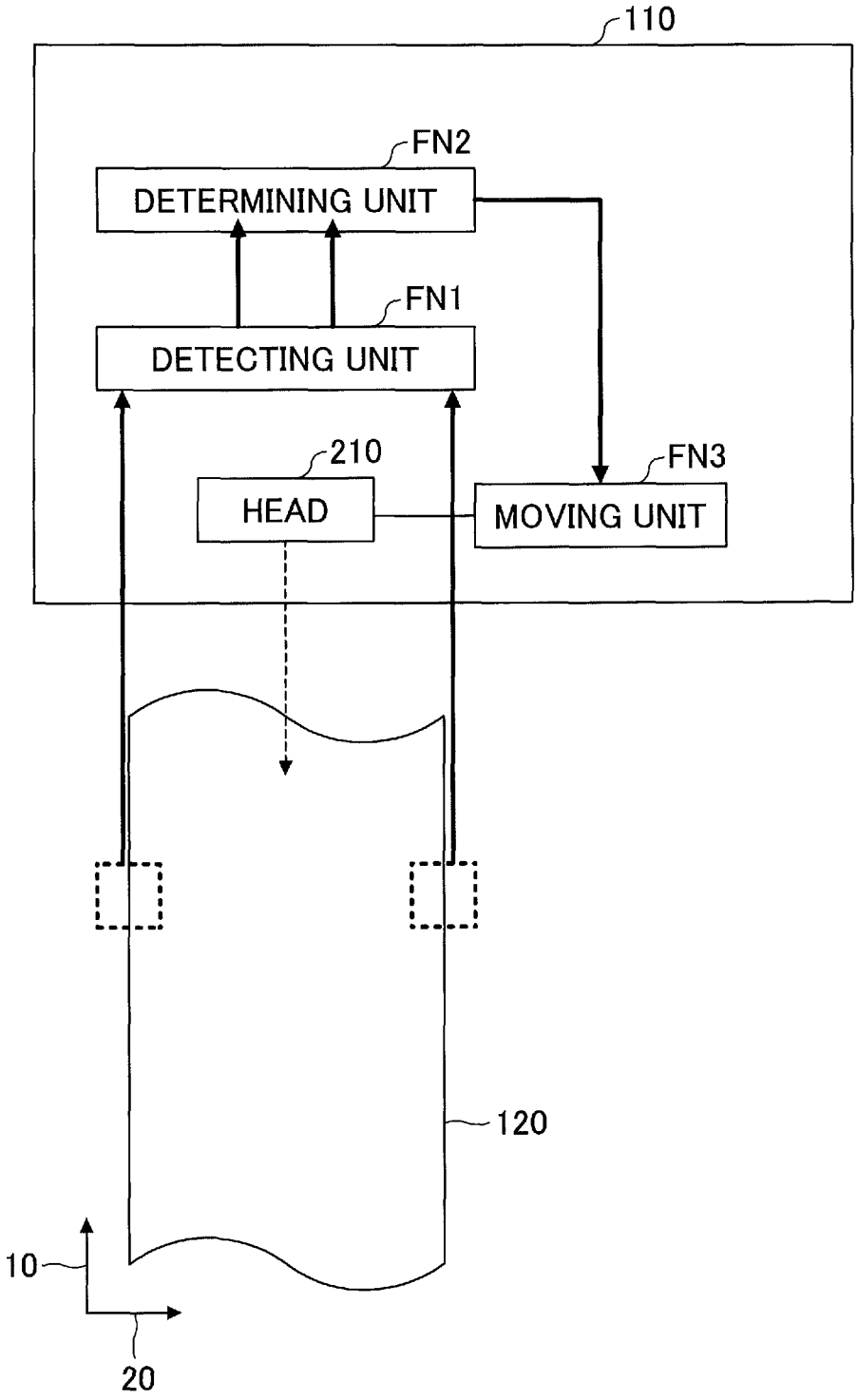
FIG. 10 is a block diagram illustrating an example of a functional configuration of the conveying apparatus according to an embodiment of the present invention.

FIG. 10 is a block diagram illustrating an example of a functional configuration of the conveying apparatus according to an embodiment of the present invention. For example, the image forming apparatus 110 includes a detecting unit FN1 and a determining unit FN2. In addition, it is preferable for the image forming apparatus 110 to include a moving unit FN3. The example of the functional configuration will be described below.

The detecting unit FN1 detects the positions of a plurality of portions in the orthogonal direction of a conveyance object. For example, the detecting unit FN1 is implemented by the first sensor E1S and the second sensor E2S.

The determining unit FN2 determines whether the conveyance object has expanded or contracted in the orthogonal direction based on detection results of the positions of the plurality of portions. For example, the determining unit FN2 is implemented by the controller 520.

When the determining unit FN2 determines that the conveyance object has expanded or contracted, the moving unit FN3 moves the heads, which perform a process on the conveyance object, in the orthogonal direction, based on the amount of expansion or contraction and also the direction of expansion or contraction. For example, the moving unit FN3 is implemented by the moving mechanism illustrated in FIG. 9.

For example, as illustrated in FIG. 8, when the positions of a plurality of edge portions, such as upper and lower end portions, of the conveyance object are detected, detection results as illustrated in FIG. 7 or FIG. 8 can be obtained. Accordingly, the image forming apparatus 110 can determine whether the conveyance object has expanded or contracted based on such detection results. That is, the image forming apparatus 110 can distinguish expansion or contraction of the conveyance object from movement in the orthogonal direction of the conveyance object during the conveyance of the conveyance object.

Further, a method for moving the heads may differ depending on whether the conveyance object has "meandered" or the conveyance object has "expanded or contracted". Accordingly, the image forming apparatus 110 can perform a process on the conveyance object with high accuracy by determining expansion or contraction of the conveyance object and moving the heads in accordance with the amount of expansion or contraction.

Comparison Example

Figure 11:
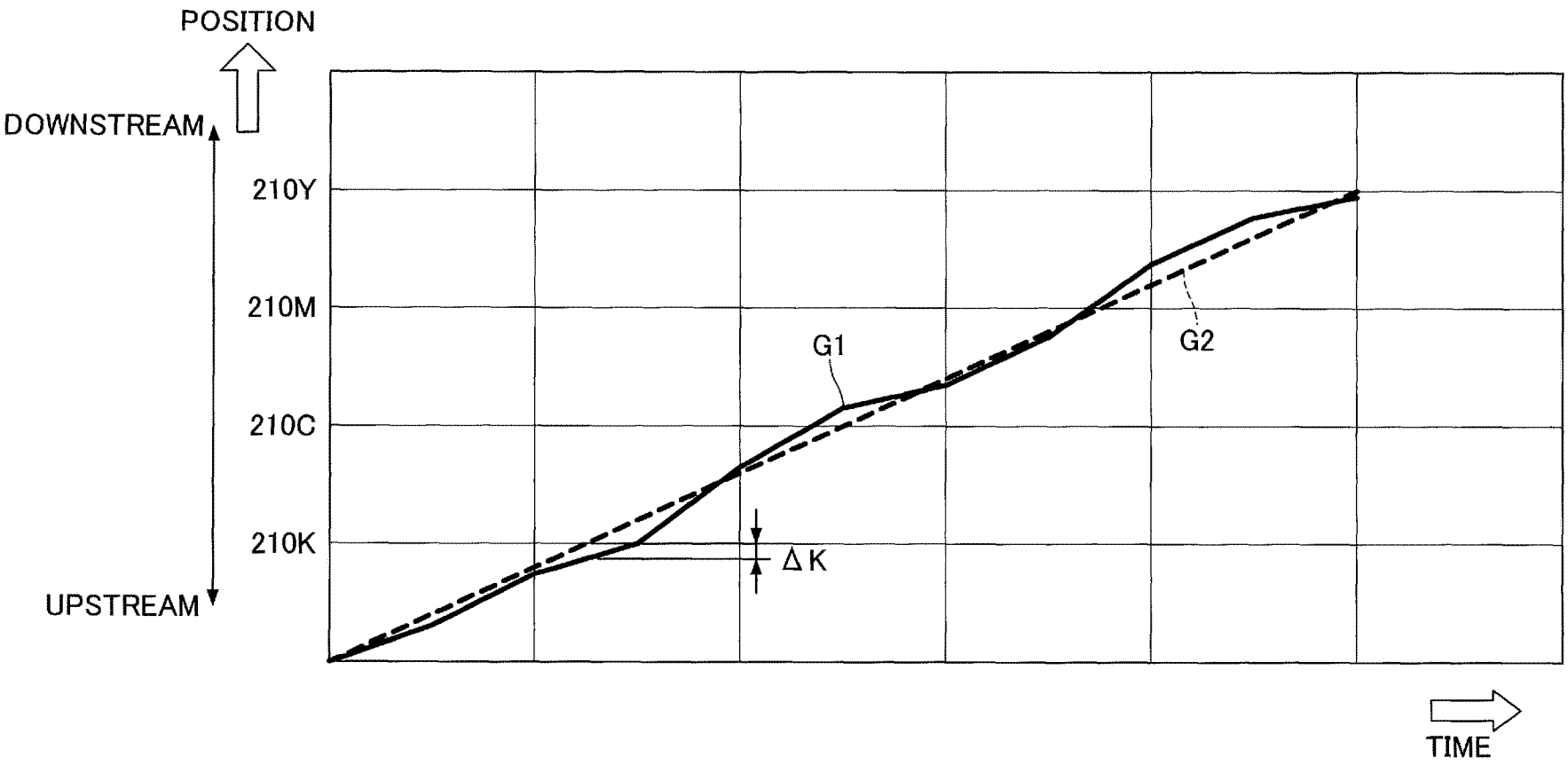
FIG. 11 is a graph illustrating example shifts in landing positions that occur in an image forming apparatus according to a comparative example.

FIG. 11 is a graph illustrating example shifts in landing positions that occur in an image forming apparatus according to a comparative example. Specifically, FIG. 11 illustrates example shifts in the landing positions of liquid ejected from liquid ejection head units of the image forming apparatus according to the comparative example.

In FIG. 11, a first line G1 represents an actual position of a web. A second line G2 represents a calculated position of the web, calculated based on an encoder pulse output from an encoder ENC. As can be seen from the graph, there are differences between the first line G1 and the second line G2. In such a case, because the actual position of the web in the conveying direction is different from the calculated position of the web, the landing positions of liquid tend to be shifted.

For example, as in the example illustrated in FIG. 11, the landing position of liquid ejected from the black liquid ejection head unit 210K is shifted by a shift amount ΔK due to the difference between the actual position and the calculated position of the web. Further, the shift amount may differ for each liquid ejection head unit. That is, the shift amount ΔK of the black liquid ejection head unit 210K and shift amounts of the other liquid ejection head units are likely to be different.

Shifts in the liquid landing positions may be caused by roller eccentricity, thermal expansion of rollers, slippage between the web and the rollers, expansion and contraction of a recording medium, or combinations thereof, for example.

Figure 12:
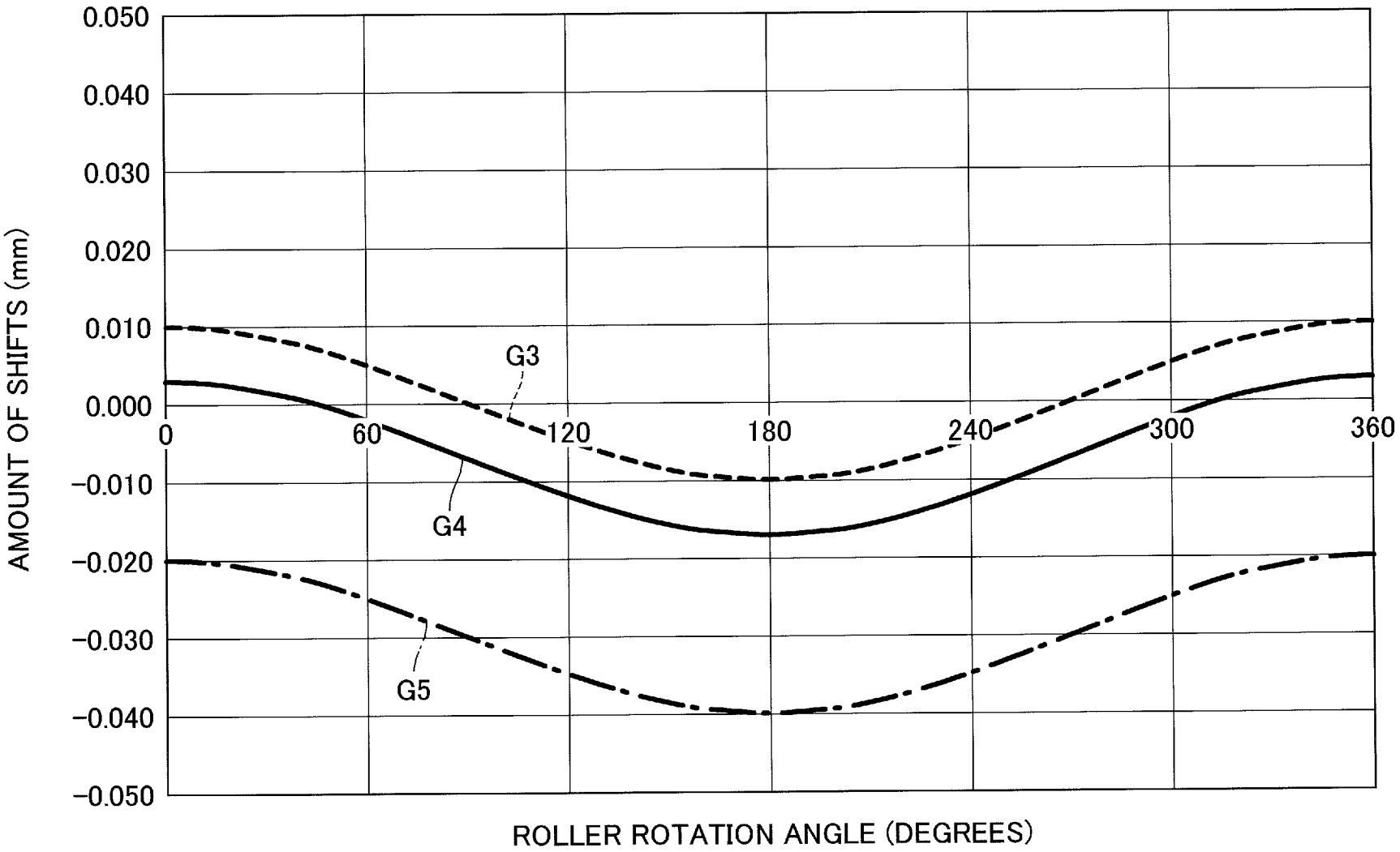
FIG. 12 is a graph illustrating example influences such as roller eccentricity on shifts in the landing positions.

FIG. 12 is a graph illustrating example influences such as roller eccentricity on shifts in the landing positions. Specifically, the graph illustrates example influences of slippage between the rollers and the web, of thermal expansion, and of roller eccentricity on shifts in the landing positions. That is, as the amount of shifts, a third line G3 through a fifth line G5 each indicate, on the vertical axis, the difference between the actual position of the web and the calculated position of the web, calculated based on the encoder signal from the encoder ENC. Further, in the example of FIG. 12, each of the rollers is made of aluminum and has an outer diameter of "φ60".

The third line G3 indicates the amount of shifts when roller eccentricity is "0.01 mm". As can be seen from the third line G3, the amount of shifts due to roller eccentricity may often synchronize with the rotation cycle of the rollers. Also, the amount of shifts due to roller eccentricity is often proportional to the amount of eccentricity, but is not accumulated in many cases.

The fourth line G4 indicates the amount of shifts when eccentricity and thermal expansion of the rollers are present. Note that the fourth line G4 illustrates an example in which thermal expansion is caused by a temperature change of "−10° C.".

The fifth line G5 indicates the amount of shifts when eccentricity of the rollers and slippage between the web and the rollers are present. Note that the fifth line G5 illustrates an example in which the slippage between the web and the rollers is "0.1%".

Further, in order to reduce the meandering of the web, the web may be pulled in the conveying direction by being subjected to tension. In some cases, such tension may cause expansion and/or contraction of the web. The expansion and/or contraction of the web may vary depending on the thickness of the web, the width of the web, or the amount of coating applied to the web, for example.

Other Embodiments

In the above-described embodiments, an example in which the heads are moved has been described; however, the present invention is not limited thereto. The conveying apparatus may be configured to move a conveyance object (a recording medium), or may be configured to move both the heads and the conveyance object. That is, the conveying apparatus may move the heads and/or the conveyance object as long as the conveying apparatus can change the relative positional relationship between the heads and the conveyance object.

Further, note that the positions to be detected are not necessarily the positions of edge portions of a conveyance object. For example, marks may be used for detection. Specifically, a pattern may be formed by emitting light from a light source onto the conveyance object, and the formed pattern may be detected by an optical sensor and converted into coordinates. By detecting such patterns at different positions in the conveying direction of the conveyance object, whether or not the conveyance object is moved in the orthogonal direction can be determined from coordinates. The positions may be detected by such a method.

However, it is preferable to detect the positions of end portions such as edge portions of the conveyance object. The end portions such as edge portions of the conveyance object may be detected by an edge sensor or an optical sensor without applying marks on the conveyance object. In addition, when the conveyance object has "meandered", obvious detection results are likely to be obtained at the end portions of the conveyance object, as compared to the central portions. Therefore, the movement in the orthogonal direction of the conveyance object can be more accurately detected.

Note that the liquid ejection apparatus according to an embodiment of the present invention may be implemented by a liquid ejection system including one or more liquid ejection apparatuses. For example, in some embodiments, the black liquid ejection head unit 210K and the cyan liquid ejection head unit 210C may be included in one housing of one liquid ejection apparatus, and the magenta liquid ejection head unit 210M and the yellow liquid ejection head unit 210Y may be included in another housing of another liquid ejection apparatus. In this case, the liquid ejection apparatus according to an embodiment of the present invention may be implemented by a liquid ejection system including both of the above liquid ejection apparatuses.

Further, note that liquid ejected from the liquid ejection apparatus and the liquid ejection system according to an embodiment of the present invention is not limited to ink, but may be other types of recording liquid or fixing agent, for example. That is, the liquid ejection apparatus and the liquid ejection system according to an embodiment of the present invention may also be configured to eject liquid other than ink.

Further, the liquid ejection apparatus and the liquid ejection system according to an embodiment of the present invention are not necessarily employed to form a two-dimensional image. For example, the liquid ejection apparatus and the liquid ejection system according to an embodiment of the present invention may form a three-dimensional object.

Further, the conveyance object is not limited to a recording medium such as paper. The conveyance object may be any material onto which liquid can be ejected. For example, any material including paper, thread, fiber, cloth, leather, metal, plastic, glass, wood, a ceramic material, or a combination thereof may be used, as long as liquid can at least temporarily adhere to the material.

Further, the present invention can be applied to an apparatus that performs any process by using line-type head units arranged in a direction orthogonal to the conveying direction of an object to be conveyed.

For example, the conveying apparatus according to an embodiment of the present invention may have a configuration in which head units emit laser onto a substrate, which is an example of a conveyance object, so as to form a pattern on the substrate. Specifically, the conveying apparatus may include head units arranged in a line in a direction orthogonal to the conveying direction of the substrate. Then, the conveying apparatus detects positions of the substrate, and moves the head units based on detection results of the positions. In this example, a processing position corresponds to a position of the substrate onto which laser is emitted.

Further, the conveying apparatus does not necessarily include the plurality of head units. The present invention may also be applied to a case in which one head unit continues to perform a process on a conveyance object at one reference position.

Further, embodiments of the present invention may be implemented by a program that causes a computer of the conveying apparatus, an information processing apparatus, or a combination thereof to execute a part or all of a liquid ejection method.

According to an embodiment of the present invention, it is possible to distinguish expansion or contraction of a conveyance object from movement in the orthogonal direction of the conveyance object during the conveyance of the conveyance object.

Although the embodiments have been specifically described above, the present invention is not limited to the specific embodiments, and numerous variations and modifications may be made without departing from the scope of the present invention.

What is claimed is:

1. A conveying apparatus for conveying a conveyance object in a conveying direction, comprising:

a detecting unit configured to detect positions of a plurality of edge portions in an orthogonal direction of the conveyance object during the conveyance of the conveyance object, the orthogonal direction being orthogonal to the conveying direction, and a determining unit configured to make a determination as to whether the conveyance object has been subjected, to expansion or contraction in the orthogonal direction, based on detection results of the positions of the plurality of the edge portions.

2. The conveying apparatus according to claim 1, wherein the conveying apparatus is configured to shift the conveyance object so as to cancel an effect of the expansion or contraction, in accordance with meandering of the conveyance object.

3. The conveying apparatus according to claim 1, wherein the plurality of portions include a first portion and a second portion, and the determining unit makes the determination based on a combined result including a first detection result of a first position of the first portion and a second detection result of a second position of the second portion.

4. The conveying apparatus according to claim 3, wherein the detecting unit detects reference positions of the plurality of portions while the conveyance object is being stopped and is being subjected to first tension, and the determining unit uses detection results of the reference positions of the plurality of portions to make the determination.

5. The conveying apparatus according to claim 1, further comprising a moving unit configured to move a head that performs a process on the conveyance object, wherein, when the determining unit determines that the conveyance object has been subjected to the expansion or contraction, the moving unit moves the head in the orthogonal direction based on an amount of the expansion or contraction and also a direction of the expansion or contraction.

6. The conveying apparatus according to claim 1, wherein the plurality of the edge portions include end portions in the orthogonal direction of the conveyance object.

7. An image forming apparatus for conveying a conveyance object in a conveying direction, and for forming an image on the conveyance object, comprising:

a detecting unit configured to detect positions of a plurality of edge portions in an orthogonal direction of the conveyance object during the conveyance of the conveyance object, the orthogonal direction being orthogonal to the conveying direction; and a determining unit configured to make a determination as to whether the conveyance object has been subjected to expansion or contraction in the orthogonal direction, based on detection results of the positions of the plurality of the edge portions.

8. The conveying apparatus according to claim 1, wherein the detecting unit includes a plurality of edge sensors configured to detect the positions of the plurality of edge portions.

* * * * *